US006688088B1

(12) United States Patent
Aweeka, Jr.

(10) Patent No.: US 6,688,088 B1
(45) Date of Patent: Feb. 10, 2004

(54) HORSE MOUNTING AID AND METHOD

(76) Inventor: Edward N. Aweeka, Jr., 535 Calle Bonito Ct., Sparks, NV (US) 89436

( * ) Notice: Subject to any disclaimer, the term of this patent is extended or adjusted under 35 U.S.C. 154(b) by 27 days.

(21) Appl. No.: 10/242,938

(22) Filed: Sep. 13, 2002

(51) Int. Cl.[7] ..... B68C 1/16
(52) U.S. Cl. ..... 54/46.1
(58) Field of Search ..... 54/46.1, 47; 24/198, 24/200

(56) References Cited

U.S. PATENT DOCUMENTS

| | | | | | |
|---|---|---|---|---|---|
| 13,778 | A | * | 11/1855 | Kerr | 278/73 |
| 330,213 | A | * | 11/1885 | Deweese | 54/34 |
| 469,957 | A | * | 3/1892 | Blood | 54/46.1 |
| 592,587 | A | * | 10/1897 | Hollister | 54/46.1 |
| 1,335,826 | A | * | 4/1920 | Faithfull | 54/46.2 |
| 3,234,711 | A | * | 2/1966 | Jamieson | 54/46.1 |
| 3,672,004 | A | * | 6/1972 | Smith | 24/302 |
| 4,881,303 | A | * | 11/1989 | Martini | 24/170 |
| 5,216,874 | A | * | 6/1993 | Farrow | 54/46.1 |
| 5,347,797 | A | * | 9/1994 | Seal et al. | 54/46.1 |
| 5,661,957 | A | * | 9/1997 | Daly | 54/47 |
| 5,865,203 | A | * | 2/1999 | Villano | 135/65 |

* cited by examiner

*Primary Examiner*—Son T Nguyen
(74) *Attorney, Agent, or Firm*—Herbert C. Schulze

(57) ABSTRACT

This is a method and apparatus for assisting persons to mount a saddle upon a horse in which a step-up member is adjustably carried by a rigid member which is in turn carried by a stirrup leather and a stirrup leather buckle. The rigid member is moveably mounted on the stirrup leather and it carries an adjustable cord having a step-up member which can be utilized to raise a person on one foot to a position where the other foot can comfortably be placed into the stirrup. The device is so configured as to be under a saddle side jockey and/or fender so as to be non-interfering with the rider's leg and not noticeable when not in use.

2 Claims, 3 Drawing Sheets

HORSE MOUNTING AID AND METHOD

CROSS REFERENCE TO RELATED PATENT APPLICATIONS

There are no Pending Patent Applications Filed by me related to the within Application.

BACKGROUND OF THE INVENTION

I. Field of the Invention

This invention is in the general fields of horsemanship and equestrian equipment.

The invention is more particularly directed to the fields of equestrian training, proper horse mounting techniques, and instruction.

The invention is most particularly in the fields of assistive devices and techniques for achieving safe and proper horse and saddle mounting for children and other riders requiring particular assistance due to inability when to raise a foot high enough from the ground to reach a stirrup when attempting to mount onto a saddle by supplying an auxiliary stirrup-like device which can drop from the saddle to a position closer to the ground than the stirrup which will be used when actually riding. The rider is able to raise his/her foot to a position lower than the stirrup and thus mount properly, after which the auxiliary device can be maneuvered into a position which does not interfere with riding comfort or safety.

II. Description of the Prior Art

A problem which has plagued the equestrian world for a long time is the difficulty of short persons mounting a saddle on a horse as is explained more completely in the Summary of the Invention, which follows. As a result, there have been many attempts to solve the problem. I am listing a few United States Patents which have issued on attempted solutions for the problem. The following list is not intended as a disclosure document, but merely to indicate the state of the art: U.S. Pat. Nos. 5,661,957; 6,173,558 B1; 4,601,161; 4,608,812.

I have studied the methods used and the approaches of the above listed patents as well as others which have been directed at a solution to the problem mentioned. In all of the items I have been able to find the result is usually cumbersome in itself and/or interference with proper comfort and safety during riding. I have tried to utilize principles suggested by all of the prior attempts to solve this problem, but I have found that all the previous items fail for the reason stated.

Therefore, I abandoned everything I could find an set out to design a solution to the problem ignoring all that I could find which went before. For this reason, I believe there is not prior art which can properly be considered to be prior art as to the principles upon which my invention is based.

SUMMARY OF THE INVENTION

Horseback riding is always popular and seems to be gaining in popularity. A major problem for many beginning riders, especially children, short persons, and persons with leg mobility difficulty is the mere mounting onto the saddle. The position of the stirrup is such that a person may be unable to lift his/her foot high enough to get the foot into the stirrup. Ironically, the shorter the leg, the more the problem is aggravated as the stirrup will be shorter, and therefore higher from the ground.

This difficulty has been the subject of many patents and much discussion and consideration. Some of the patents in this field have been listed above, not for their applicability to my present invention, but merely to indicate what has been done and suggested. None of these inventions solves one portion of the problem. That portion is that while there have been numerous attempts to lengthen the stirrup or stirrup straps or supplement them, such attempts result in cumbersome attachments or otherwise interfere with the stirrup when riding. This may result in discomfort and, more importantly, may become a hazard.

After much planning, design and engineering study, and experimentation I have now conceived and developed a unique, novel, and useful solution to the problem. What I have accomplished is a method and apparatus which provides an independent temporary stirrup which is supported by the buckle (my new invention works well with any type western saddle stirrup buckle such as Blevins buckles, roller buckles, or others) of the properly fitting stirrup used in riding, and which can be drawn up under the fender and/or side jockey out of any possible interference with the proper stirrup when riding, and it does not interfere with, or cause discomfort to, the rider's leg. In fact it is not noticeable at all when it is withdrawn after a rider has mounted the saddle.

My new mounting aid is light weight, inexpensive, and requires no special tools nor unusual techniques in use. It hangs directly below, and in alignment with, the regular stirrup. Also, my mounting aid, being mounted above the buckle and on the stirrup leather will turn with the stirrup. A rider preparing to mount onto a saddle may grasp the stirrup in order to insert his/her left foot into the stirrup while facing toward the left side of the horse and then turn while rising and throw his/her right leg over the cantle and then settle onto the seat. With my device the right foot is placed onto the suspended extension bar. The rider then stands on his right foot on the extension bar as though he was standing on the ground. The left foot is then placed in the stirrup and the rider proceeds exactly as though he/she was starting to mount in the usual manner. All motions in finally assuming a seat on the saddle are natural and normal.

It is an object of this invention to provide a mounting aid for a rider mounting a western saddle on a horse;

Another object is to provide a method for making the mounting of a horse relatively easier than when using the normal riding stirrup in mounting;

Another object is to provide a safe method for mounting a horse;

Another object is to provide a horse mounting aid which does not interfere with normal riding;

The foregoing and other objects and advantages of this invention will become apparent to those skilled in the art upon reading the description of a preferred embodiment, which follows, in conjunction with a review of the appended drawings.

DESCRIPTION OF A PREFERRED EMBODIMENT

Figure 1:
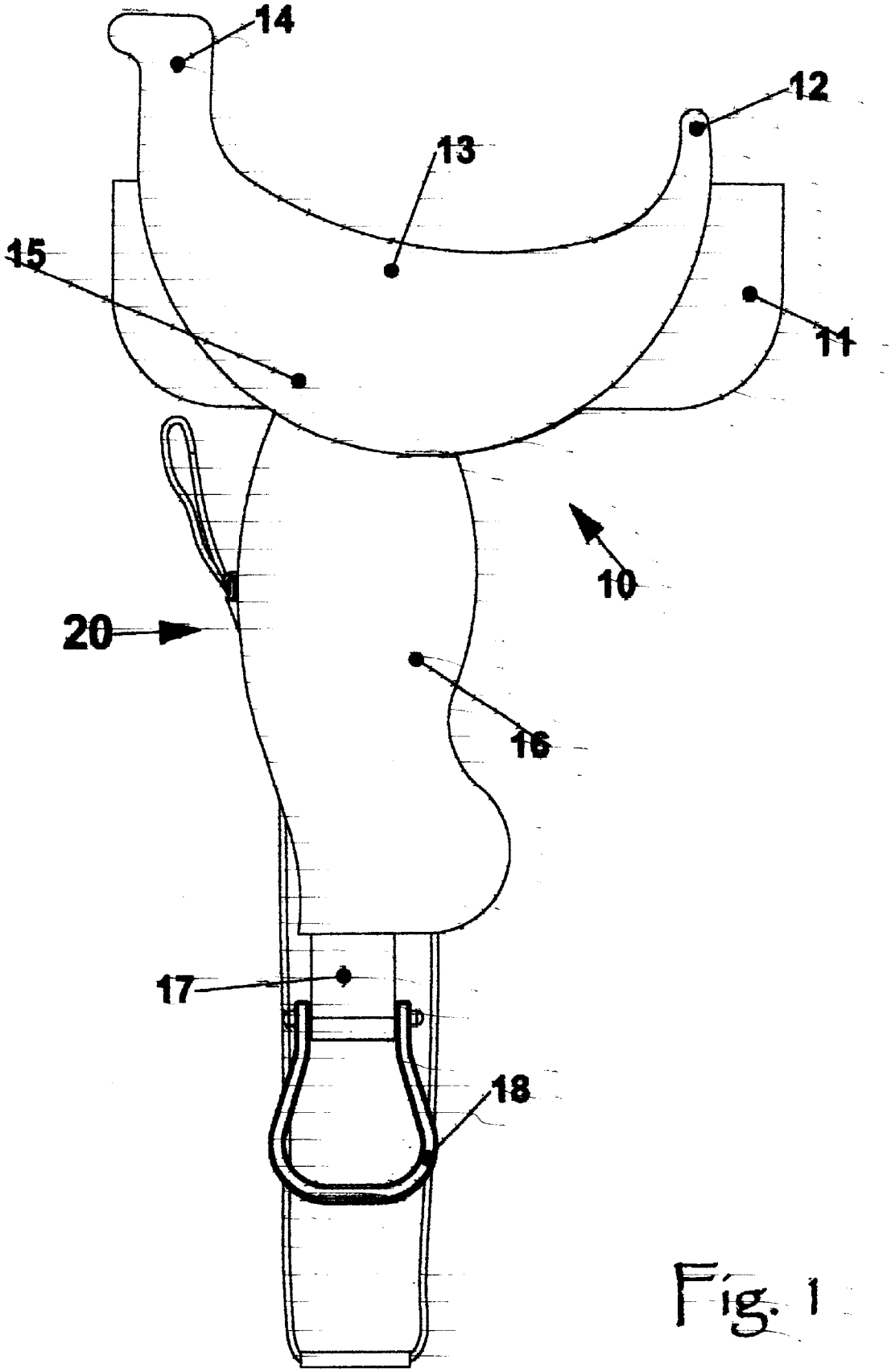
FIG. 1 is a schematic left side elevation of a saddle equipped with a device suitable to practice the method of this invention.

An inventory of elements on the drawings bearing reference numerals is:

| Numeral | Element |
|---|---|
| 10 | saddle |
| 11 | skirt |
| 12 | cantle |
| 13 | seat |
| 14 | horn |
| 15 | side jockey |
| 16 | fender |
| 17 | stirrup leather |
| 18 | stirrup |
| 19 | buckle |
| 20 | device suitable to practice the method of this invention, generally |
| 21 | extension mounting block |
| 22 | stirrup leather slot |
| 23 | cord |
| 24 | step-up element |
| 25 | knot |
| 26 | loop |

Figure 2:
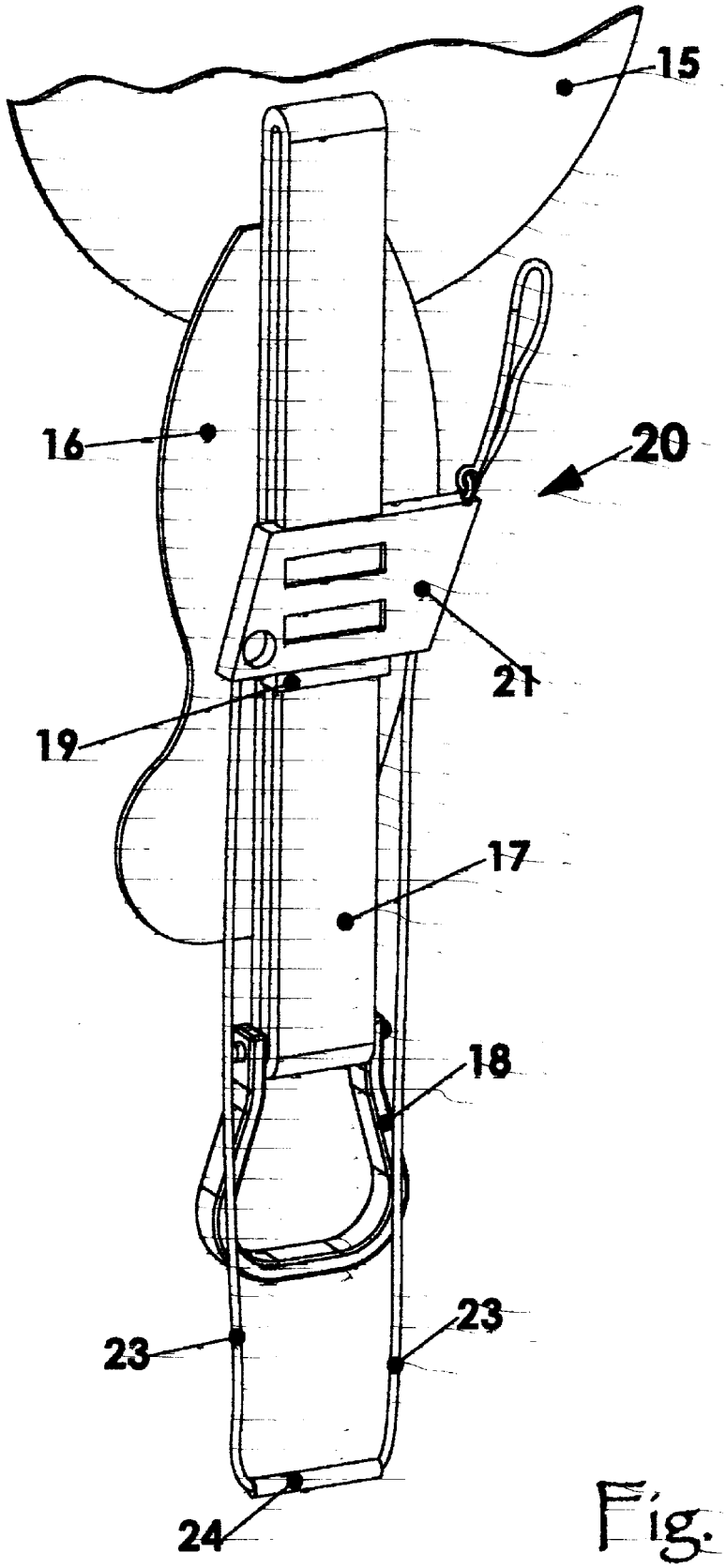
FIG. 2 is an enlarged schematic elevation of the reverse side of the device of FIG. 1 mounted on the stirrup leather and buckle with other elements except the saddle fender and broken away jockey removed.
Figure 3:
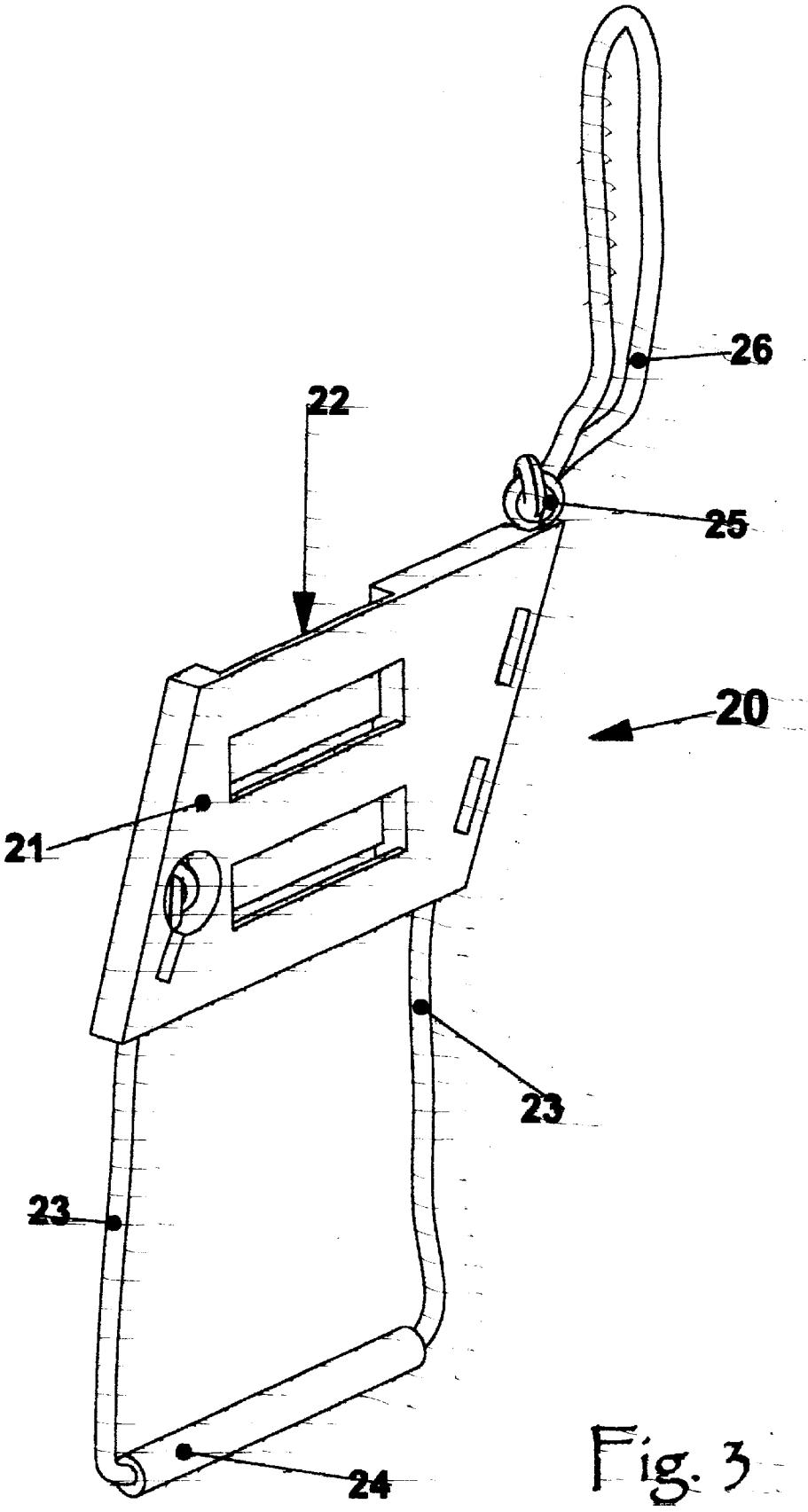
FIG. 3 is an enlarged perspective of the device of FIGS. 1 and 2 removed from all of the saddle elements.

FIGS. 1 and 2 should be viewed together and show a saddle 10 having the usual saddle elements such as skirt 11, cantle 12, seat 13, horn 14, side jockey 15, fender 16, stirrup leather 17, stirrup 18, and stirrup buckle 19.

The stirrup leather 17 is shown to be equipped with a device 20 suitable to practice the method of this invention. When in this condition and prior to mounting, the stirrup equipped with my invention is as shown in FIG. 2. In FIG. 2 it will be noted that the height relationship of the stirrup 18 to the step-up element 24 once fixed cannot change due to the fact that they extension mounting block rests on the stirrup buckle 19. Thus, once fixed in place at the ideal position for a particular rider the loop 26 formed by knot 25 on the cord 23 will remain constant assuring repetitive uses with the same step-up position for the step-up element 24.

When the rider has mounted, the loop 26 can be pulled up and looped over the horn on the saddle. It is, thus, held unobtrusively out of any possible interference or view under the fender 16 and/or the side jockey 15.

In the claims which follow if I fail to claim a patentable feature of this invention such failure will be the result of inadvertence and not due to any intent to dedicate or abandon such feature. In such event, upon discover such failure to claim I shall immediately take any appropriate steps to cure the inadvertence.

While the embodiment shown and described is fully capable of achieving the objects and advantages desired, such embodiment has been shown for purposes of illustration only and not for purposes of limitation.

I claim:

1. A method for mounting onto a saddle having at least one stirrup on a horse standing on a base comprising: fastening a saddle onto a horse, affixing a moveable rigid member having an adjustable extendable step-up member to a stirrup leather on said saddle; sliding the moveable rigid member into contact with a stirrup leather buckle fastened to said stirrup leather; adjusting the step-up member to a position intermediate the stirrup and the base; placing a horse rider's first foot on said step-up member; causing the horse rider to stand upright on the first foot on said step-up member; causing the horse rider to place a second foot into and upon the stirrup; removing the first foot from the step-up member; moving the first foot over the saddle; and causing the horse rider to sit on a seat portion of said saddle thus completing the mounting process.

2. The method of claim 1 wherein the saddle has two stirrups one of which is on a first side of a horse and the other of which is on a second side of the horse; the slidable member is placed upon a stirrup leather on the first side and the moving of the first foot over the saddle is followed by placing said first foot into and upon the stirrup on the second side of the horse.

* * * * *